United States Patent [19]

Snyder, Jr.

[11] 3,978,809

[45] Sept. 7, 1976

[54] ROLLER TRAVELLER DEVICE

[76] Inventor: Francis H. Snyder, Jr., Rte. 7, Brookfield, Conn. 06804

[22] Filed: July 28, 1975

[21] Appl. No.: 599,356

[52] U.S. Cl. ..... 114/204; 114/39; 114/112

[51] Int. Cl.[2] ..... B63H 9/10

[58] Field of Search ..... 114/102, 111, 112, 218, 114/204

[56] References Cited

UNITED STATES PATENTS 3,118,418 1/1964 Faul ..... 114/218

3,828,714 8/1974 Perkins ..... 114/218

FOREIGN PATENTS OR APPLICATIONS 1,065,202 4/1967 United Kingdom ..... 114/102

*Primary Examiner*—Duane A. Reger
*Assistant Examiner*—Gregory W. O'Connor
*Attorney, Agent, or Firm*—Bucknam and Archer

[57] ABSTRACT

A traveller device for positioning a sail and having a carrier that is moveable on rollers along a guide track. The rollers project on opposite sides of the carrier and are arranged in spaced-apart relation along the length thereof to engage with rolling contact, longitudinally extending surfaces of the guide track.

2 Claims, 3 Drawing Figures

ROLLER TRAVELLER DEVICE

BACKGROUND AND SUMMARY OF THE INVENTION

This invention relates in general to equipment for sail boats and more particularly to a traveller device for positioning a sail.

In the prior art there are a variety of traveller devices used for positioning sails on different types of boats. These devices have relied upon the use of carrier bodies with flat surfaces which slide along the surfaces of a guide rail. In one such traveller device, the carrier body slide surfaces were on flat blades which projected one from each side of the carrier body.

These traveller devices which had sliding surface contact with the guide track were subject to certain disadvantages, such as excessive frictional resistance, easy blockage by sand and salt particles, and excessive vulnerability to rapid progressive failure. If a crack developed at one end of a slider blade, such crack would readily extend under load until the entire blade became separated from the carrier body.

The traveller device of the subject invention has a carrier body disposed for longitudinal movement along a guide track, and a base with at least one fitting, which base is connected to the carrier body for movement therewith to adjust a line that controls a sail, whereby the position of such sail is established by the location of the carrier body on the guide track. The invention provides an improvement which comprises a plurality of rollers borne by the carrier body on opposite sides thereof. These rollers are disposed in spaced-apart relation along the length of the carrier body and for rolling contact engagement with longitudinally extending surfaces of the guide track to accommodate the movement of the carrier body therealong.

In accordance with a preferred embodiment of the invention, the carrier body is made of a strong and somewhat elastic plastic material such as DELRIN, commonly designated as an elastomeric material, and the rollers are supported on axles that extend transversely through the carrier body and are supported thereby for rotation relative thereto.

It has been found that by using a series of independent rollers and an elastomeric carrier body, frictional resistance is reduced and there is no progressive failure problem as was encountered with slider blades. Particularly where the traveller device is used on small sailing catamarans, it is possible to have a low profile C-shaped cross section guide track, and to use correspondingly small diameter rollers, and yet have a much higher load safety factor than would be possible with slider blades of the same thickness as the roller diameter.

For a better understanding of the invention and its various advantages, reference should be had to the following detailed description and accompanying drawing which together exemplify a certain preferred embodiment of the invention.

DESCRIPTION OF A PREFERRED EMBODIMENT OF THE INVENTION

Figure 1:
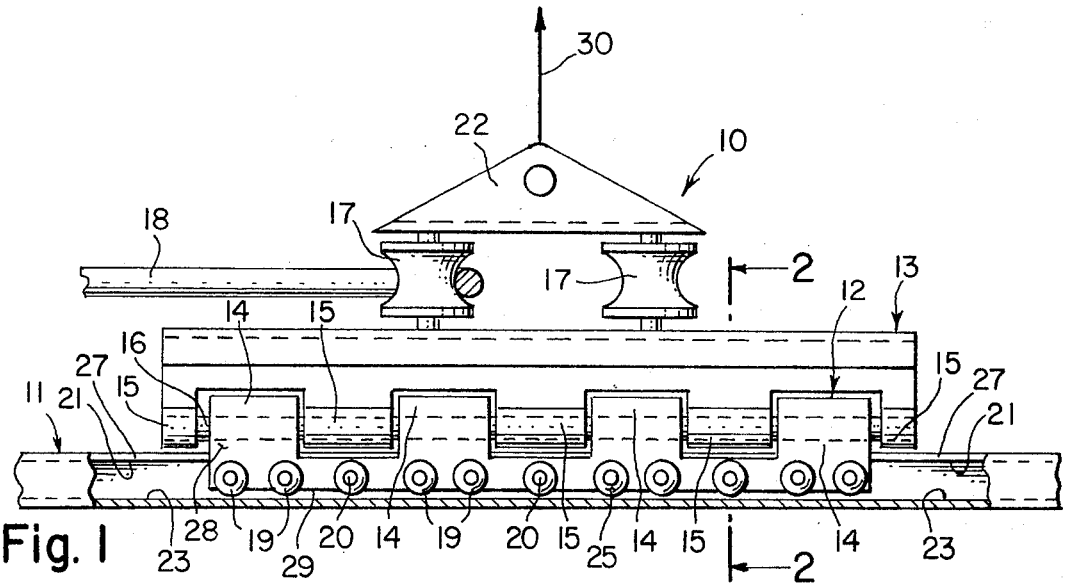
FIG. 1 is an elevation view, partly in section of a traveller device according to a preferred embodiment of the invention, as seen installed for use in an associated guide track, and looking at right angles to the track longitudinal centerline.
Figure 2:
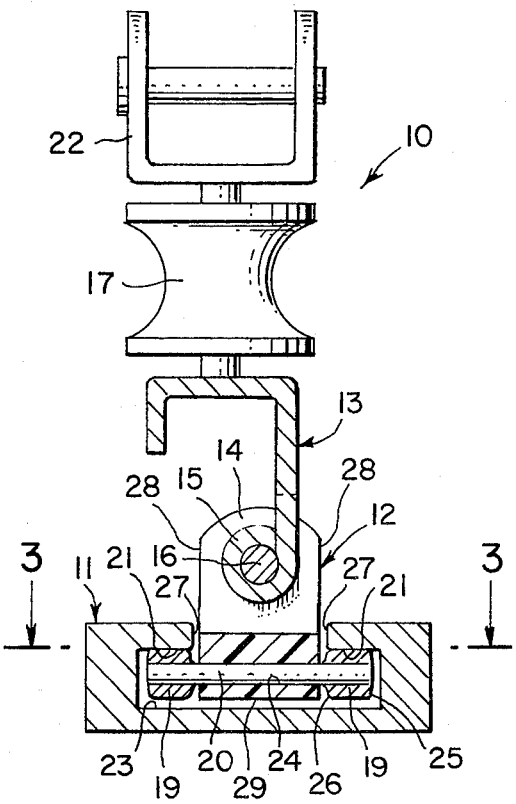
FIG. 2 is a transverse cross sectional view of the traveller device and guide track shown in FIG. 1 as taken along line 2—2 therein.
Figure 3:
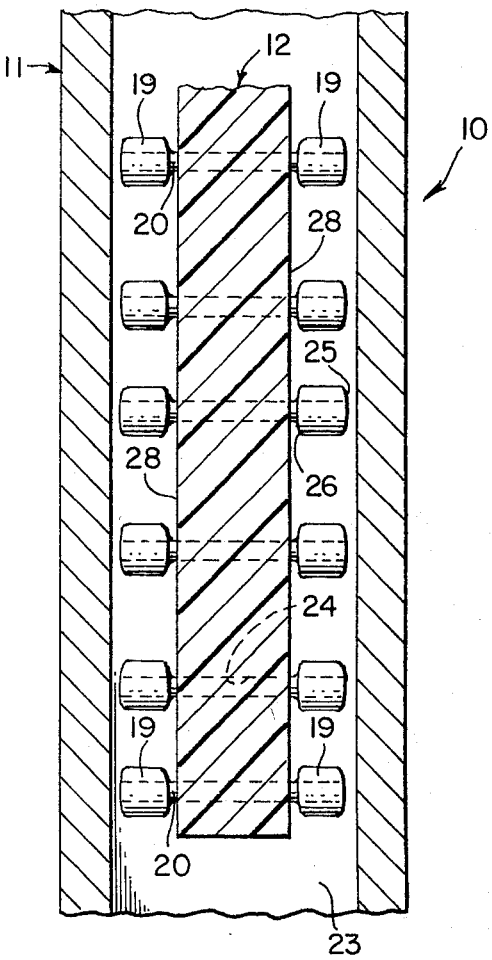
FIG. 3 is a cross sectional view of the traveller device and guide track shown in FIG. 2 as taken along line 3—3 therein.

In FIGS. 1–3 there is exemplified a traveller device 10 used for positioning a sail (not shown) on a boat such as a small catamaran (not shown) upon which has been installed a guide track 11.

Device 10 has a carrier body 12, preferrably molded out of a durable elastomeric material, such as DELRIN. Carrier body 12 is disposed for longitudinal movement along guide track 11, and to body 12 is connected a base 13 for movement therewith. On body 12 and base 13 are respective hinge parts 14 and 15 through which a pin 16 extends, such that base 13 can pivot relative to body 12 about a longitudinally directed axis.

On the top of base 13 is mounted at least one fitting, in this particular example, a pair of pulleys 17 that receive a line 18 between them. Line 18 is a typical line which is used to position the sail. Accordingly, the position of such sail is established by the location of the carrier body 12 on the guide track 11. Once the carrier body 12 is at a selected position on track 11, it can be held thereat by securing line 18 to any suitable means (not shown) on the boat.

To facilitate movement of the carrier body 12 with a minimum of friction, there are provided a plurality of rollers 19 borne by the body 12 on opposite sides thereof. Rollers 19 are supported by respective axles 20 that extend transversely through the carrier body 12 and these axles 20 are supported by body 12 for rotation relative thereto. Expediently a roller 19 is press fitted on each end of the typical axle 20, and body 12 is drilled through to receive each axle 20 with sufficient diametial clearance to allow free axle 20 rotation, but without excessive play. Rollers 19 are disposed in spaced-apart relation along the length of body 12 and for rolling contact engagement with longitudinally extending surfaces 21 of track 11 to accommodate the movement of body 12 therealong.

It should be noted that the block piece 22 associated with pulleys 17 is normally connected to another line (not shown) that exerts a pull-down force on the boom of the sail being positioned by the device 10, and thus the rollers 19 will be urged against the upper inside surfaces 21 of the C-shaped cross section of track 11 rather than against the lower inside surface 23 thereof.

The number and inter-axle spacing of rollers 19 can be varied somewhat, however it has been found advantageous to use more than a minimum of two axles 20 each with a pair of rollers 19.

The number, size and arrangement of the rollers 19 and their axles is determined by the normal force applied at the individual roller and rail contact zone. This normal roller unit force can be considered approximately as the component normal to surfaces 21 of the total load carried by the device 10 divided by the number of rollers 19. In the practice of the invention, a number of rollers 19 are used such that the unit force does not exceed the elastic return modulus of either the individual roller 19 or the guide track 11. With unit force exceeding such elastic return modulus, both rolling friction and wear rate increase dramatically.

One advantage found in using a carrier body 12 of an elastomeric material is that such body 12 can undergo limited flexing to allow substantially all rollers 19 to stay in rolling contact engagement with the surfaces 21 even though there may be normal manufacturing tolerances giving high and low spots on surfaces 21, on the alignment of the axles 20, and on the diameters of rollers 19.

Rigidly supported rollers 19, when taken in conjunction with ordinary manufacturing tolerances are not practical because peaks and valleys in the guide track surface 21 and/or variations in roller contact locations can cause the entire load to be put upon only the most prominent rollers 19 in a multiple roller 19 group, which can cause excessive friction and early wear failure.

Carrier body 12 therefore is capable of limited flexing to thereby equalize the load carried by the several rollers 19, such that manufacturing tolerances are less critical.

The rollers 19 and their axles 20 are preferably of uniform dimensions respectively, and the rollers 19 are expediently of a diameter which fits somewhat loosely between the inside surface 23 and contact surfaces 21 of guide track 11.

For a given load capacity to be carried by the traveller device 10, the number of rollers 19 and axles 20 can be chosen to give a selected safety factor. From the loading on the individual axle 20, its diameter and the size of the axle receiving passage 24 through body 12 is determined consistent with the chosen safety factor. It has been found that a minimum axle center-line-to centerline spacing equal to 5 times the passage 24 diameter give satisfactory performance in most cases.

The rollers 19 and axles 20 are expediently made of a corrosion resistant steel or other metal alloy.

Preferably, the end faces of rollers 19 are spherically crowned as at 25 and 26 for smoother operation under conditions where sand and salt particles get inside the guide track 11.

During operation of the traveller device 10 there will be forces applied thereto tending to tilt the carrier body 12 about its longitudinal axis and push it toward one or the other of the inner edges 27 of the guide track flanges. This feature is utilized to create frictional forces acting upon the body 12 by contact with the guide track 11, tending to hold the device 10 at a given setting along track 11. For such purpose, the body 12 is dimensioned in relation to the guide track 11 cross-sectional dimensions such that there are clearances allowing the sides 28 of body 12 to bear frictionally against respective edges 27 of track 11 in accordance with lateral forces exerted upon the body 12. In addition, these clearances allow the bottom 29 of body 12 to bear frictionally or heel against the surface 23 of track 11 when body 12 is subjected to a movement about its longitudinal axis. Consequently, while line 18 can be manipulated to selectively limit the outward movement of the traveller device 10 with respect to either side of the mid-length point on track 11, the device 10 will not be subject to continual shifting as the boat rocks slightly.

Under typical operating conditions, one end of line 18 is fixed to the boat and the other end is pulled and secured in a clamp (not shown) also fixed to the boat so that in effect line 18 is a loop that bears against one or the other of pulleys 17 to limit how far outboard the traveller device 10 can be pulled by the sail boom (not shown).

The sail boom is ordinarily connected to the traveller device 10 by a line, shown schematically at 30 that is connected to the block piece 22. When the sail boom, under the force of wind, is set to one side of the track 11 midpoint, line 18 will bear against one pulley 17, whereas when the boom is set to the opposite side of the track 11 midpoint, line 18 will bear against the other pully 17.

The rollers 19 thereby allow the setting of the device 10 to be easily shifted by adjusting line 18, whereas the friction between surface elements 28, 29 of carrier body 12 and surface elements 27, 23 of the track 11 serves to hold device 10 against unintended shifting inboard.

What is claimed is:

1. In a traveller device for positioning a sail, and having a carrier body disposed for longitudinal movement along a guide track, a base with at least one fitting, connected to said carrier body for movement therewith to adjust a line that controls a sail whereby the position of such sail is established by the location of the carrier body on the guide track, the improvement which comprises:

a plurality of rollers borne by said carrier body on opposite sides thereof, said rollers including at least three pairs of rollers, each pair of which is supported on a separate axle that extends transversely through the carrier body and is supported thereby for rotation relative thereto, said rollers being disposed in spaced-apart relation along the length of the carrier body and for rolling contact engagement with longitudinally extending surfaces of the guide track to accommodate the movement of the carrier body therealong;

said carrier body having a limited elastic flexibility operable to maintain all of said rollers in rolling contact engagement with said longitudinally extending surfaces of the guide track as against limited deviations of said surfaces from a planar configuration;

said base being hingedly connected to the carrier body for pivotal movement relative thereto about a longitudinally extending axis;

and said carrier body having surfaces disposed to frictionally engage said guide track under the influence of transversely directed forces applied to the carrier body by said base through the hinged connection thereof.

2. The improvement according to claim 1 wherein said carrier body is made of an elastomeric material.

* * * * *